US012084213B2

(12) United States Patent
Köster

(10) Patent No.: US 12,084,213 B2
(45) Date of Patent: Sep. 10, 2024

(54) METHOD AND DEVICE FOR STRAPPING A GROUP OF PACKAGES

(71) Applicant: Focke & Co. (GmbH & Co. KG), Verden (DE)

(72) Inventor: Johann Köster, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 54 days.

(21) Appl. No.: 17/999,336

(22) PCT Filed: May 21, 2021

(86) PCT No.: PCT/EP2021/063682

§ 371 (c)(1),
(2) Date: Nov. 18, 2022

(87) PCT Pub. No.: WO2021/239625

PCT Pub. Date: Dec. 2, 2021

(65) Prior Publication Data

US 2023/0182942 A1 Jun. 15, 2023

(30) Foreign Application Priority Data

May 26, 2020 (DE) ..... 102020114037.1

(51) Int. Cl.
*B65B 13/02* (2006.01)
*B65B 19/02* (2006.01)
*B65D 63/10* (2006.01)

(52) U.S. Cl.
CPC ..... *B65B 19/02* (2013.01); *B65B 13/02* (2013.01); *B65D 63/1009* (2013.01)

(58) Field of Classification Search
CPC ..... B65D 63/1009; B65D 85/1072; B65B 19/02; B65B 13/02
See application file for complete search history.

(56) References Cited

U.S. PATENT DOCUMENTS 2,605,897 A * 8/1952 Rundle ..... B65D 75/68 206/264
3,556,910 A * 1/1971 Derenthal ..... B65B 13/10 226/176

(Continued)

FOREIGN PATENT DOCUMENTS

DE 1109081 A 6/1961
DE 4120480 A1 12/1992

(Continued)

OTHER PUBLICATIONS

WIPO, International Search Report (in the parent application), Sep. 3, 2021.

(Continued)

*Primary Examiner* — Andrew M Tecco
(74) *Attorney, Agent, or Firm* — Laurence P. Colton; Smith Tempel Blaha LLC

(57) ABSTRACT

A method for strapping a group of packages, in particular for products of the cigarette industry, with a strip of packaging material, wherein the packages are brought together to form a cuboid group and are then strapped with at least one strip of packaging material. The at least one strip of packaging material is provided on one side with a preferably continuous layer of adhesive, and the group of packages is completely strapped with the at least one strip of packaging material, wherein the layer of adhesive is brought into direct contact with the packages of the group.

20 Claims, 7 Drawing Sheets

(56) References Cited

U.S. PATENT DOCUMENTS

| | | | | |
|---|---|---|---|---|
| 3,982,375 | A * | 9/1976 | Focke | B65B 11/58 53/228 |
| 4,114,355 | A * | 9/1978 | Davies | B65B 61/08 83/88 |
| 5,461,841 | A * | 10/1995 | Spada | B65B 19/228 53/228 |
| 5,735,104 | A * | 4/1998 | Odenthal | B65D 71/00 53/399 |
| 7,458,196 | B2 | 12/2008 | Luca | |
| 7,503,153 | B2 * | 3/2009 | De Matteis | B65B 11/10 53/223 |
| 8,046,978 | B2 * | 11/2011 | Pipes | B65B 35/52 53/399 |
| 8,307,613 | B2 * | 11/2012 | Pipes | B65B 35/52 53/399 |
| 2009/0056276 | A1 * | 3/2009 | Yohe | B65B 9/02 53/398 |
| 2012/0023868 | A1 | 2/2012 | Pipes | |
| 2014/0075885 | A1 * | 3/2014 | Perl | B65B 13/02 53/399 |
| 2022/0396416 | A1 * | 12/2022 | Hodges | B65D 63/1009 |

FOREIGN PATENT DOCUMENTS

| | | | |
|---|---|---|---|
| DE | 4213463 | A1 | 10/1993 |
| DE | 4411473 | A1 | 10/1995 |
| DE | 29608305 | U1 | 8/1996 |
| DE | 19608967 | A1 | 9/1997 |
| DE | 10105486 | A1 | 5/2002 |
| DE | 20320955 | U1 | 8/2005 |
| EP | 0921074 | A1 | 6/1999 |
| EP | 2305563 | A2 | 4/2011 |
| FR | 3002921 | A1 | 9/2014 |
| GB | 2299319 | A | 10/1996 |
| JP | 2000327020 | A | 11/2000 |
| KR | 101420577 | B1 | 7/2014 |
| WO | 9506603 | A1 | 3/1995 |

OTHER PUBLICATIONS

Deutsches Patent—UND Markenamt (German Patent and Trademark Office), Recherchebericht (search in a related application), Dec. 11, 2020.

European Patent Office, Remarks Concerning The Patentability Of European Patent Application (filed by 3rd party in associated application), Oct. 11, 2023.

* cited by examiner

METHOD AND DEVICE FOR STRAPPING A GROUP OF PACKAGES

CROSS REFERENCE TO RELATED APPLICATIONS

This application is the US national phase of and claims the benefit of and priority on International Application No. PCT/EP2021/063682 having an international filing date of 21 May 2021, which claims priority on and the benefit of German Patent Application No. 10 2020 114 037.1 having a filing date of 26 May 2020.

BACKGROUND OF THE INVENTION

Technical Field

The invention relates to a method for strapping a group of packages, in particular for products of the cigarette industry, with a strip of packaging material, wherein the packages are brought together to form a cuboid group and are then strapped with at least one strip of packaging material.

The invention moreover relates to a corresponding device for strapping a group of packages, in particular for products of the cigarette industry, with a strip of packaging material, wherein the packages are brought together to form a cuboid group and are strapped with at least one strip of packaging material.

Prior Art

A method for strapping a group of packages is known from DE 44 11 473 A1 (see FIG. 1). Two strips of packaging material are here placed around a group of packages and hold the group together.

BRIEF SUMMARY OF THE INVENTION

Starting from this background, the object of the invention is to teach a method and a device by means of which such strapping of a group of products can be produced simply and cost-effectively.

In order to achieve this object, a method according to the invention is a method for strapping a group of packages, in particular for products of the cigarette industry, with a strip of packaging material, wherein the packages are brought together to form a cuboid group and are then strapped with at least one strip of packaging material, characterized in that the at least one strip of packaging material is provided on one side with a preferably continuous layer of adhesive, and in that the group of packages is completely strapped with the at least one strip of packaging material, wherein the layer of adhesive is brought into direct contact with the packages of the group. It is accordingly provided that the at least one strip of packaging material is provided on one side with a preferably continuous layer of adhesive, and that the group of packages is completely strapped with the at least one strip of packaging material, wherein the layer of adhesive is brought into direct contact with the packages of the group.

It is preferably provided that the cuboid group of packages is moved with a first end side of the group in a transporting direction against the at least one strip of packaging material which is held ready, and is brought into contact there with the layer of adhesive, and that the at least one strip of packaging material is afterwards placed against large-area side faces of the group whilst the group continues to be transported in the transporting direction and is then brought into contact with the region of a second end side, situated opposite the first end side, of the group, wherein ends of the at least one strip of packaging material are brought into contact with the group, forming a strapping of the group. The ends of the at least one strip of packaging material here preferably come into contact with each other such that a closed strapping of the group is formed. The ends of the strip of packaging material here absolutely must not touch the second end side. It is also conceivable that the two ends just lie next to each other. It is, however, preferably provided that the ends of the at least one strip of packaging material are folded one after the other into the second end side so that they overlap each other.

According to a preferred development of the method, it can be provided that the at least one strip of packaging material is moved through an applicator, in particular a suction drum, and that the at least one strip of packaging material is held against at least one contact surface of the applicator by means of a vacuum, wherein the layer of adhesive faces away from the contact surface.

It is preferably provided that the at least one strip of packaging material is held against a peripheral surface of the applicator.

In a preferred exemplary embodiment, it can be provided that a suction drum which is driven in rotation is used as the applicator, wherein the group of packages is transported through the suction drum, in particular between two suction rollers of the suction drum which are arranged parallel to and at a distance from each other and which have at least one contact surface.

A further particularity can consist in the applicator or the suction drum having at least one opening in order to enable the transport of the group of packages through the applicator or the suction drum, and in the at least one strip of packaging material being positioned in the region of the opening in order to be applied to the first end side of the group of packages.

Yet another particularity can consist in the two ends of the at least one strip of packaging material being applied to the group by folding devices which are arranged inside the applicator, in particular the suction drum, whilst the group of packages is moved through the applicator, in particular the suction drum.

It can then preferably also be provided that the ends of the at least one strip of packaging material are held by means of suction before the ends of the strip of packaging material are applied to the group.

It can preferably be provided that a new strip of packaging material is supplied for the next group of products whilst the ends of the at least one strip of packaging material are being joined.

A further particularity can consist in a mouthpiece, through which the group of packages is moved before the at least one strip of packaging material is applied to the group, being arranged upstream from the applicator, in particular the suction drum.

It can in particular be provided that the group of packages are transported in the transporting direction in the region of the applicator by means of a carrier belt, wherein the group of packages is held tensioned between successive carriers of the carrier belt.

It is moreover conceivable that two parallel strips of packaging material are attached to the group of packages as a strapping, wherein the two strips of packaging material are unwound from different reels and simultaneously supplied by the applicator or the suction drum and then attached.

A device for achieving the object mentioned at the beginning is a device for strapping a group of packages, in particular for products of the cigarette industry, with a strip of packaging material, wherein the packages are brought together to form a cuboid group and are strapped with at least one strip of packaging material, in particular for carrying out the method as taught herein, characterized in that the at least one strip of packaging material is provided on one side with a preferably continuous layer of adhesive, and in that the device is configured to completely strap the group of packages with the at least one strip of packaging material, wherein the layer of adhesive is brought into direct contact with the packages of the group. It is accordingly provided that the at least one strip of packaging material is provided on one side with a preferably continuous layer of adhesive and that the device is configured to completely strap the group of packages with the at least one strip of packaging material, wherein the layer of adhesive is brought into direct contact with the packages of the group.

The device preferably has an applicator, in particular a suction drum, through which the group of packages can be moved, wherein the at least one strip of packaging material is held against at least one contact surface of the applicator by means of a vacuum, and wherein the layer of adhesive faces away from the contact surface.

It can preferably be provided that the device is configured to hold the at least one strip of packaging material against a peripheral surface of the applicator, preferably by means of a vacuum.

It can furthermore be provided that the applicator is designed as a suction drum which is driven in rotation, wherein the group of packages can be transported through the suction drum, in particular between two suction rollers of the suction drum which are arranged parallel to and at a distance from each other and which have at least one contact surface.

It can in particular be provided that the applicator or the suction drum has at least one opening in order to enable the transport of the group of packages through the applicator or the suction drum, and that the at least one strip of packaging material is positioned in the region of the opening in order to be applied to the first end side of the group of packages.

A particularity of the device can consist in the device having folding devices for applying the two ends of the at least one strip of packaging material to the group of packages, which are arranged inside the applicator, in particular inside the suction drum.

Another particularity of the device can consist in the device being configured to hold the ends of the at least one strip of packaging material by means of suction before the ends of the strip of packaging material are applied to the group of packages.

Furthermore, it can be provided as a particularity of the device that a mouthpiece, through which the group of packages is moved before the at least one strip of packaging material is applied to the group, is arranged upstream from the applicator, in particular the suction drum.

Lastly, it can be provided that the group of packages can be transported in the transporting direction in the region of the applicator by means of a carrier belt, wherein the group of packages is held tensioned between successive carriers of the carrier belt.

BRIEF DESCRIPTION OF THE DRAWINGS

A preferred exemplary embodiment of the invention is explained below with the aid of the drawings, in which.

DETAILED DESCRIPTION OF PREFERRED EMBODIMENTS

Figure 1:
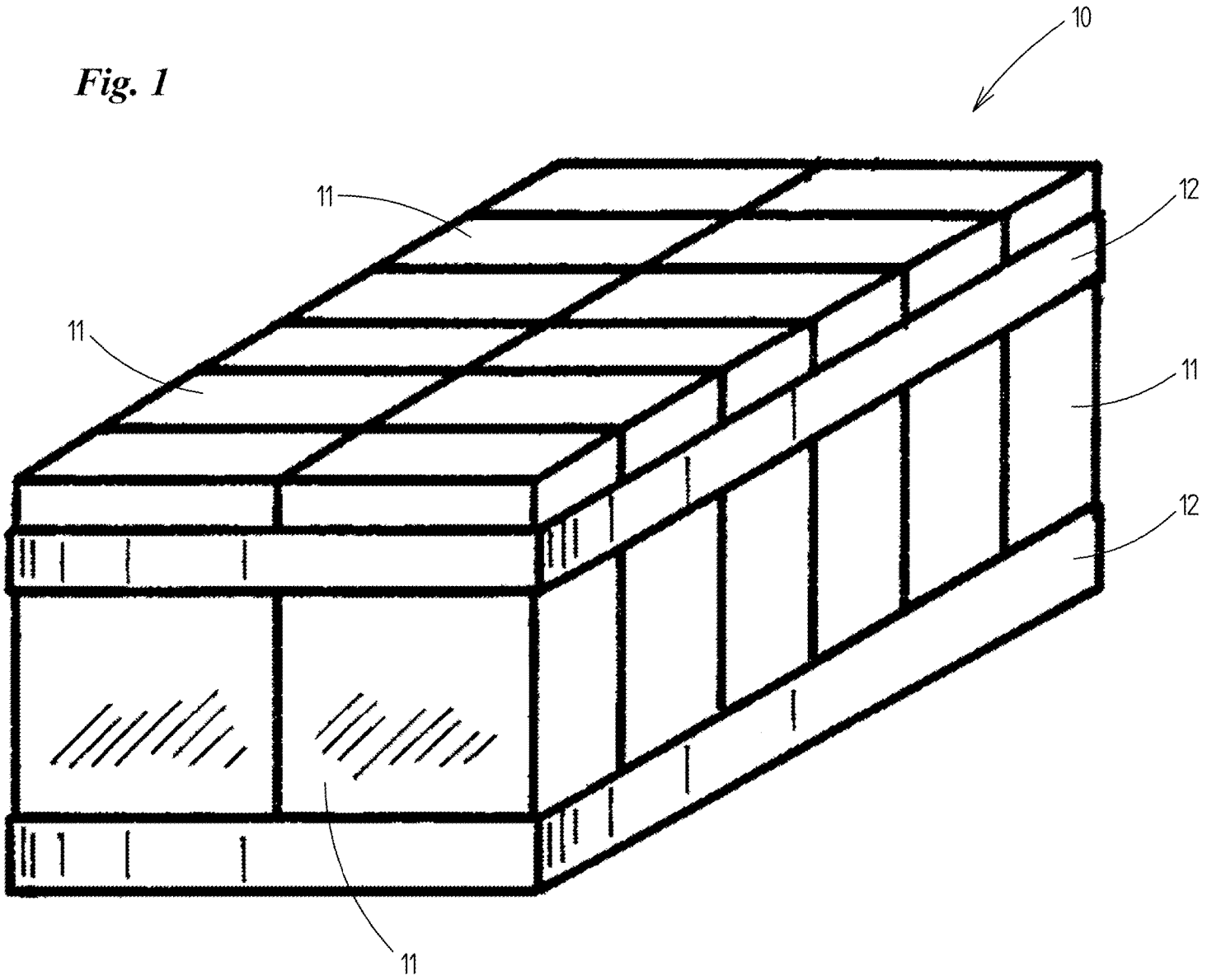
FIG. 1 shows a group of packages which are held together by two strips of packaging material.
Figure 2:
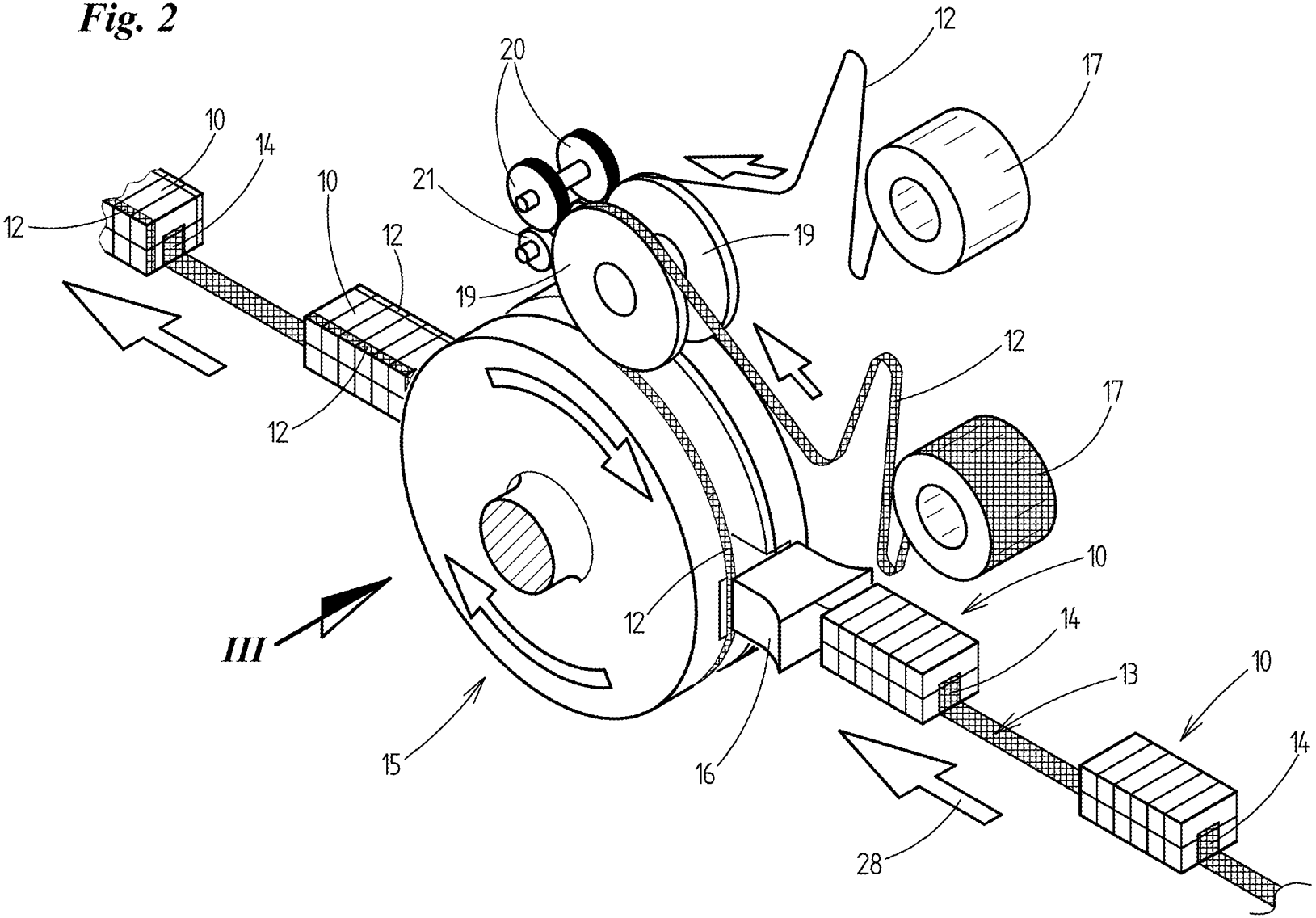
FIG. 2 shows a device for strapping the group of packages with strips of packaging material in a spatial schematic representation.
Figure 3:
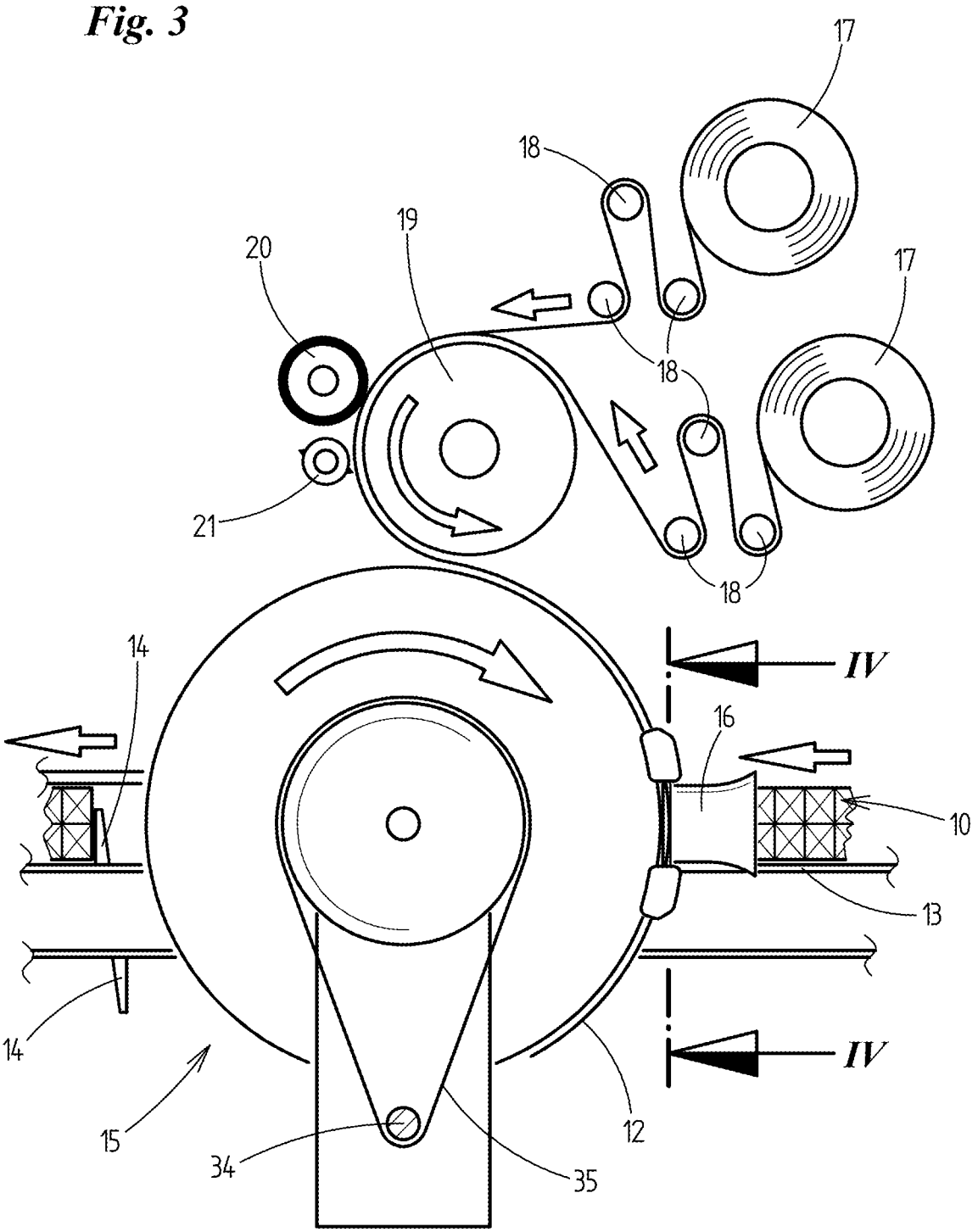
FIG. 3 shows a side view of the device in the direction of the arrow Ill in FIG. 2.
Figure 4:
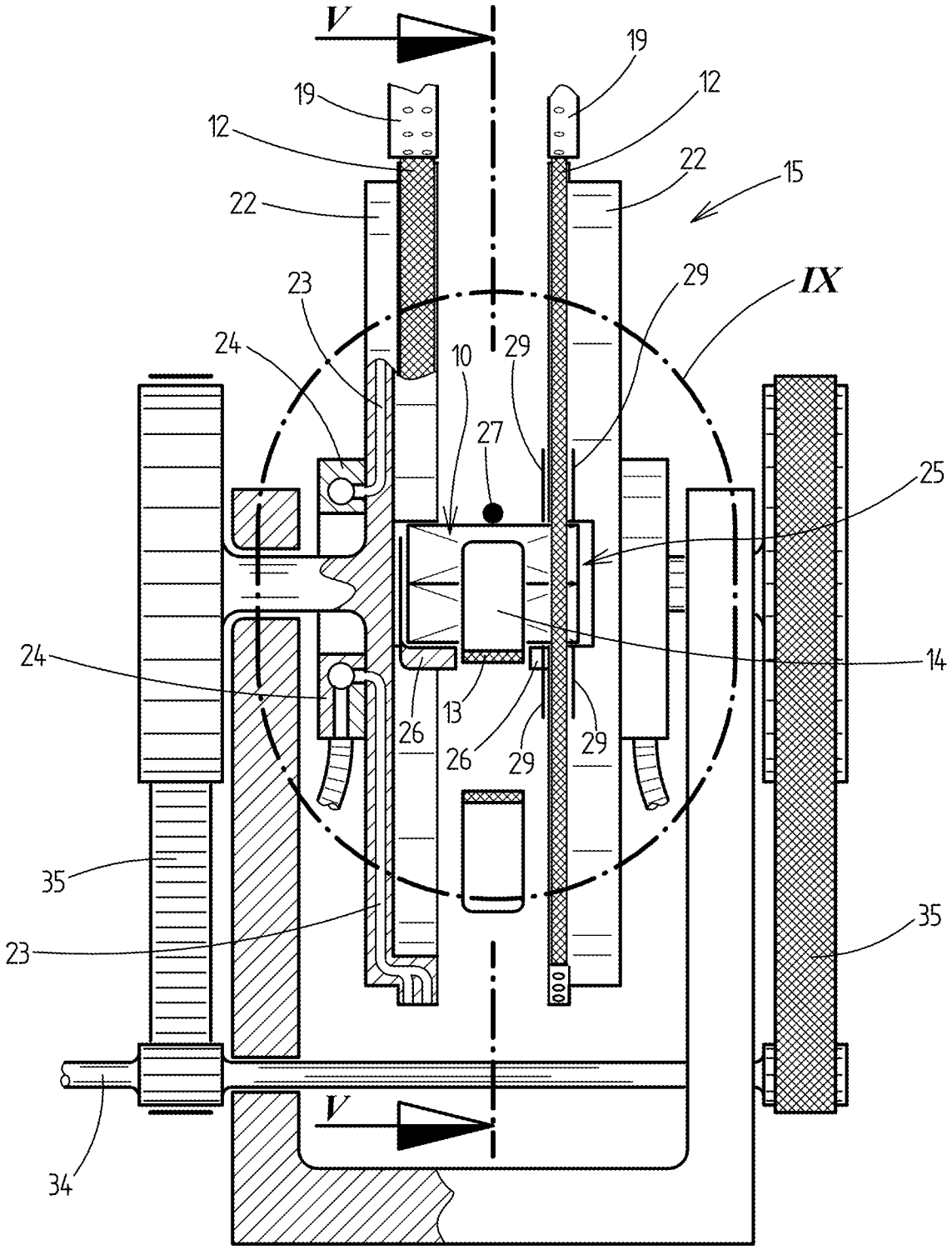
FIG. 4 shows a vertical section through the device along the line of section IV-IV in FIG. 3.
Figure 5:
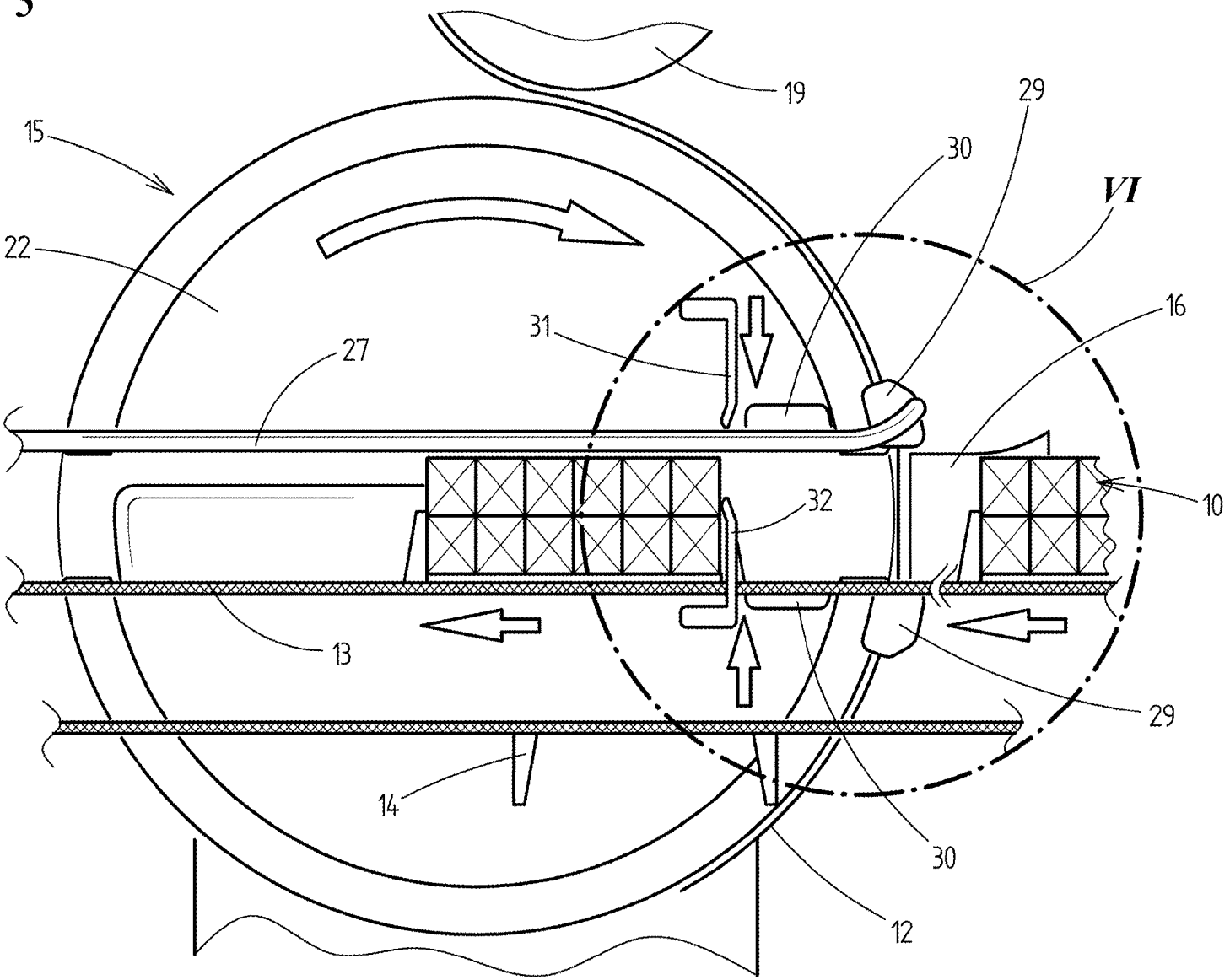
FIG. 5 shows a vertical section through the device along the line of section V-V in FIG. 4.
Figure 6:
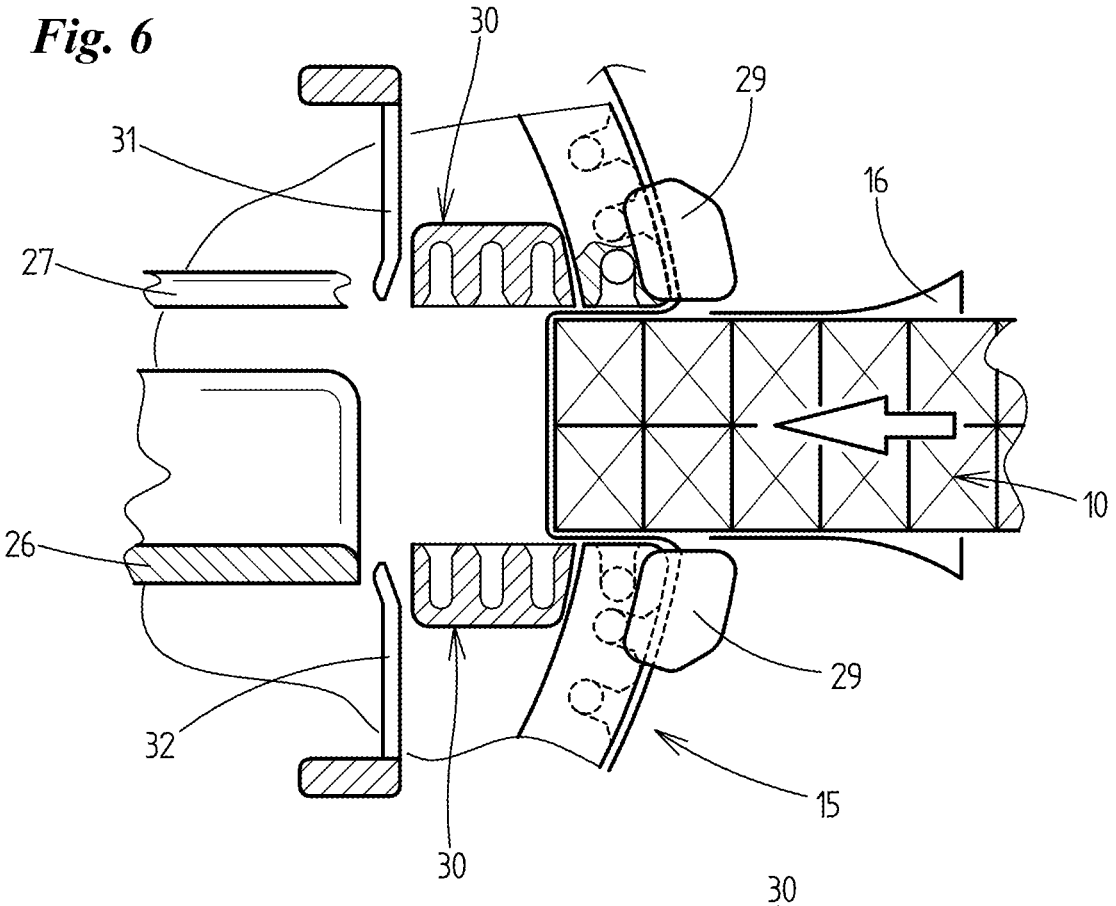
FIGS. 6 to 8 show a detail of the device in an enlarged representation in the region VI in FIG. 5 in successive phases of the sequence of the method.
Figure 7:
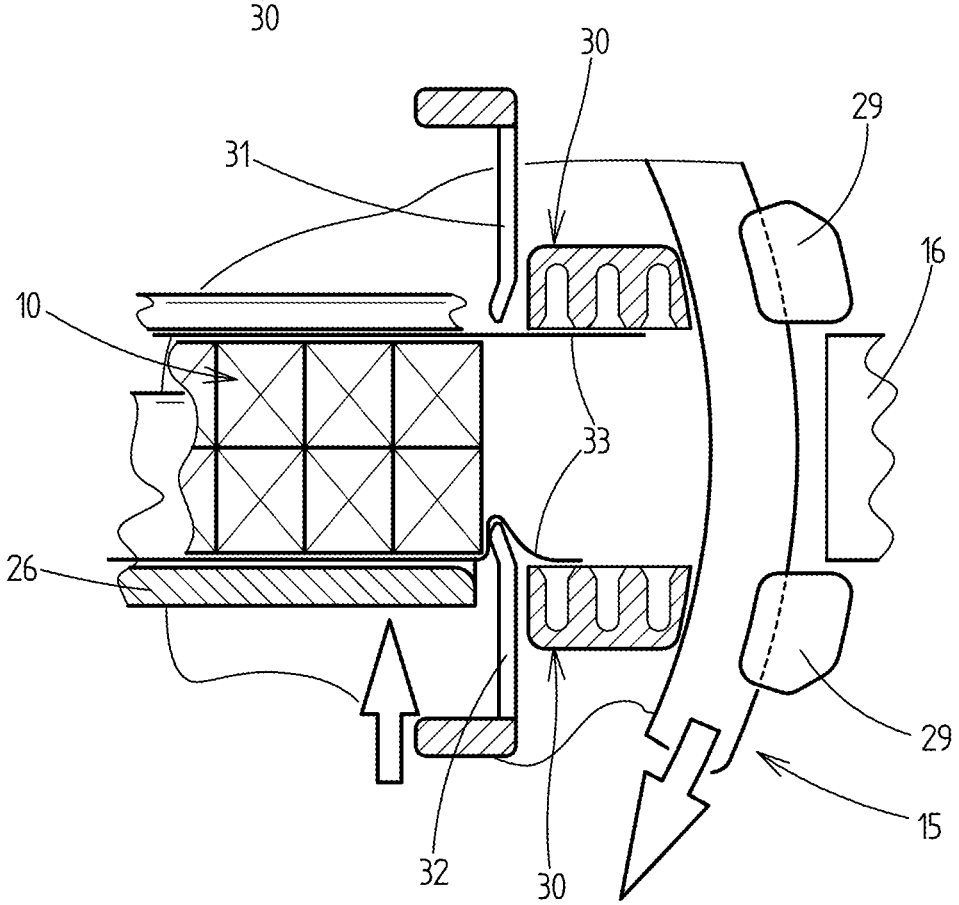

The invention is described below with the aid of a device for strapping a group 10 of cigarette packages. It should be understood that the device can also be used for strapping groups 10 of other preferably cuboid packages 11. The description below therefore does not apply specifically to cigarette packages and instead to packages 11 in general.

In the present exemplary embodiment, the packages 11 are arranged inside the cuboid group 10 in an orderly formation, namely in two layers of six packages 11 each. It should be understood that other formations are also conceivable, in particular with a different number of layers and packages per layer. The packages 11 can be brought together to form a group 10 using any procedure known from the prior art.

The packages 11 of the group 10 are held together by strips of packaging materials 12. In the present case, two strips of packaging material 12 are provided in a similar fashion to DE 44 11 473 A1. It is, however, also conceivable to use a smaller or larger number of strips of packaging material 12. It is also conceivable to dispense with a tray-forming strip of packaging material as in DE 44 11 473 A1 and use just two simple strips of packaging material (referred to there as top strips 8).

The strips 12 of packaging material can have a different width. Accordingly, one wider and one narrower strip of packaging material 12 are provided here. It should, however, also be understood that the strips of packaging material 12 can have the same or essentially the same width.

Conventional packaging materials such as, for example, plastic or a paper-based packaging material can be considered as the material for the strips of packaging material 12.

The cuboid group 10 of packages 11 is transported in a transporting direction 28 in the selected formation. For this purpose, in the present case the carrier belt 13 serves as a conveyor. The group 10 of packages 11 is here held tight or tensioned between carriers 14 of the carrier belt 13.

The carrier belt 13 runs through a suction drum 15 which serves as an applicator for the strips of packaging material 12. A mouthpiece 16, which orients the group 10 before it enters the suction drum 15, is also provided upstream from the suction drum 15. The two strips of packaging material 12 are then applied to the group 10 of packages 12 in the region of the suction drum 15.

The strips of packaging material 12 are first unwound from separate reels 17 as a continuous web of material and guided over in each case a system of deflection rollers 18 in the direction of the suction drum 15. The webs of material for the strips of packaging material 12 unwound from the reels 17 are provided on one side with a preferably continuous coating of adhesive. The deflection rollers 18 form a dancer roll system for compensating web tension and/or as a material store.

Arranged upstream from the suction drum 15 are two draw-off rollers 19. A pressure roller 20 and a blade roller 21 are in each case also provided at the periphery of the draw-off rollers 19. The pressure rollers 20 serve to press the strips of packaging material 12 against the respective draw-off roller 19. The blade rollers 21 serve to make a severing cut in the respective continuous web of material for the strips of packaging material 12.

The deflection rollers 18 are preferably silicone-coated and can be configured to hold the web of material on their periphery by means of a vacuum. The pressure rollers 20 can also have a silicone-coated or rubberized periphery and serve to press the webs of material for the strips of packaging material 12 against the draw-off rollers 19.

The webs of material for the strips of packaging material 12 are thus unwound from the reels 17 such that the coating of adhesive faces the draw-off roller 19 and is transferred from the latter to the suction drum 15 such that the coating faces outward.

The strips of packaging material 12 are transferred by a vacuum being applied to the periphery of the suction drum 15 as a contact surface for the strips of packaging material 12 such that the strips of packaging material 12 transported on the pressure roller 20 at a short distance from the periphery of the suction drum 15 are removed from the pressure roller 20 and transferred to the rotating suction drum 15. The strips of packaging material 12 are held ready for transfer to the group 10 of packages 11 by rotation of the suction drum.

FIGS. 4 to 9 show the construction of the suction drum 15 which enables transfer of the strips of packaging material 12 to the group 10 of packages 11. Accordingly, the suction drum 15 has two suction rollers 22, arranged at a distance from each other, on the periphery of which in each case one strip of packaging material 12 is held such that the coating of adhesive faces outward or in the direction of the supplied group 10 of packages 11. Suction ducts 23 in the suction rollers 22 lead to the periphery of the latter and in this way enable a vacuum to be applied to the strips of packaging material 12. The suction ducts are connected to respective vacuum feed lines 24 for supplying a vacuum.

An opening 25 for the group 10 of packages 11 is formed in the two suction rollers 22, in the present case by recesses on the respective facing inner sides of the suction rollers 22. The opening 25 is dimensioned for the group 10 of packages 11.

The construction is designed such that the group 10 of packages 11 crosses the two strips of packaging material 12 during the transporting with the carrier belt 13. In this way, the two strips of packaging material 12 are first brought into contact with an end side, situated at the front in the transporting direction, of the group and fastened thereto.

During the onward transporting, the group 10 of packages 11 rests with its underside on a bottom guide 26 which has a central recess for the carrier belt 13. The upper side of the group 10 of packages 11 rests against a top guide 27. In this way, the strips of packaging material are applied against the large-area side faces of the group 10 of packages 11 and joined there to the packages 11.

Moreover, stationary guide walls 29, not joined to the suction drum 15, for the strips of packaging material 12 are provided in the region of the opening 25. The guide walls 29 are arranged on both sides of each strip of packaging material 12 in order to stabilize the strips of packaging material 12 laterally and counteract displacement of the strips of packaging material 12.

Suction cups 30, and adjoining folding devices, namely an upper folder 31 and a lower folder 32, are moreover provided above and below the transport path in the suction drum 15.

Figure 8:
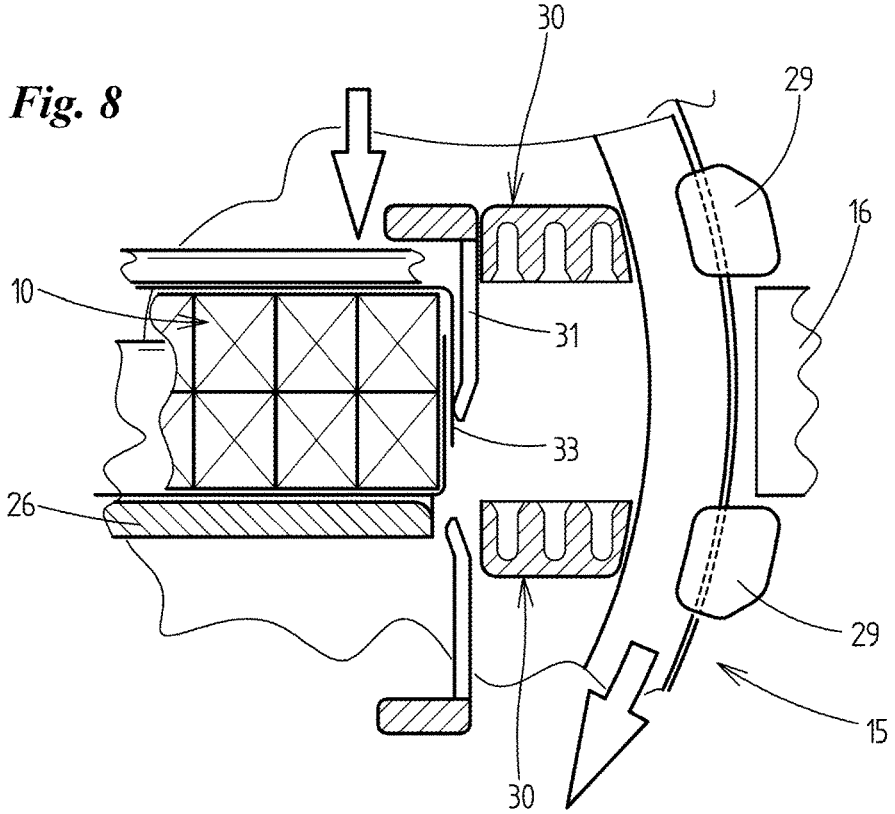
Figure 9:
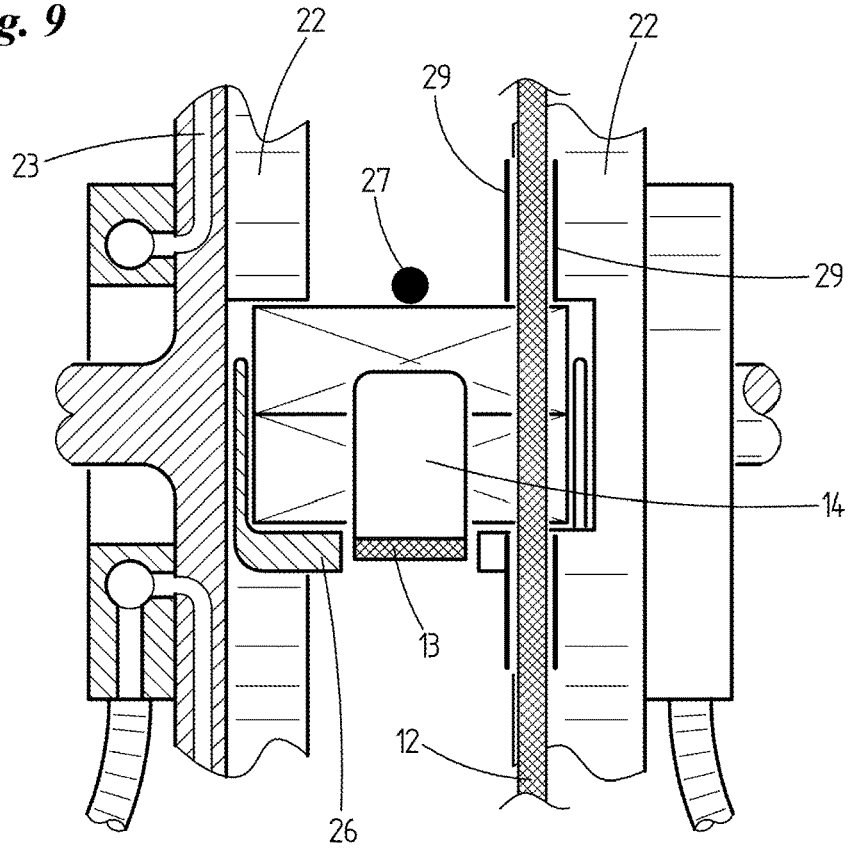
FIG. 9 shows a detail of the device in an enlarged representation in the region IX in FIG. 4.

The suction cups 30 serve to hold free ends 33 of the strips of packaging material 12 by means of a vacuum. Then a lower free end 33 is first placed against the end side of the group 10 by the lower folder 32 (FIG. 7) and in the next step an upper free end 33 is placed against the end side of the group 10 by the upper folder 31 (FIG. 8). In the meantime, the suction drum 15 is rotated further and the next strips of packaging material 12 are supplied. If the suction drum 15 has moved by 180°, the opening 25 is situated on the opposite side such that the finished group 10 can be discharged.

The upper folder 31 and the lower folder 32 each have a fork-shaped design such that they can each pull off two strips of packaging material 12 from the suction cups 30 and be applied against the packages 11 in the end side of the group 10 with slight pressure. By virtue of the fork-shaped construction, the lower folder 31 and the lower folder 32 can move past the carrier belt 13.

The suction drum 15 is driven by a servomotor. The latter drives a common shaft 34 which is joined to the suction rollers 22 via toothed belts 35. It should be understood the suction rollers 22 can also be driven individually.

In the present case, the group 10 is transported parallel to its longitudinal extent in a transporting direction 28. Transverse transporting is of course also conceivable. Likewise, the group does not have to be transported so that it lies flat and instead other orientations are also possible in this regard. The arrangement of the packages 11 within the group 10 can also be chosen differently.

LIST OF REFERENCE NUMERALS

10 group
11 package
12 strip of packaging material
13 carrier belt
14 carrier
15 suction drum
16 mouthpiece
17 reel
18 deflection roller
19 draw-off roller
20 pressure roller
21 blade roller
22 suction roller
23 suction duct
24 vacuum feed line
25 opening
26 bottom guide
27 top guide
28 transporting direction
29 guide wall
30 suction cup
31 upper folder
32 lower folder
33 end
34 shaft
35 toothed belt

The invention claimed is:

1. A method for strapping a group (10) of packages (11) of products of the cigarette industry with a strip of packaging material (12), wherein the packages (11) are brought together to form a cuboid group (10) and are then strapped with at least one strip of packaging material (12), comprising providing the at least one strip of packaging material (12) on one side with layer of adhesive, and completely strapping the group (10) of packages (11) with the at least one strip of packaging material (12), wherein the layer of adhesive is brought into direct contact with the packages (11) of the group (10), wherein the at least one strip of packaging material (12) is moved through an applicator, wherein the applicator is a suction drum (15), and wherein the at least one strip of packaging material (12) is held against at least one contact surface of the suction drum (15) by means of a vacuum, wherein the layer of adhesive faces away from the contact surface.

2. The method as claimed in claim 1, wherein the cuboid group (10) of packages (11) is moved with a first end side of the group (10) in a transporting direction (28) against the at least one strip of packaging material (12) which is held ready and is brought into contact there with the layer of adhesive, wherein the at least one strip of packaging material (12) is afterwards placed against large-area side faces of the group (10) whilst the group (10) continues to be transported in the transporting direction (28) and is then brought into contact with the region of a second end side, situated opposite the first end side, of the group (10), wherein ends (33) of the at least one strip of packaging material (12) are brought into contact with the group (10), forming a complete strapping of the group (10).

3. The method as claimed in claim 2, wherein the ends (33) of the at least one strip of packaging material (12) are folded one after the other into the second end side so that they overlap each other.

4. The method as claimed in claim 1, wherein the at least one strip of packaging material (12) is held against a peripheral surface of the suction drum (15).

5. The method as claimed in claim 4, wherein the suction drum (15) is driven in rotation, wherein the group of packages (10) is transported through the suction drum (15) between two suction rollers (22) of the suction drum (15) which are arranged parallel to and at a distance from each other and which each have at least one contact surface.

6. The method as claimed in claim 5, wherein the suction drum (15) has at least one opening (25) in order to enable the transport of the group (10) of packages (10) through the suction drum (15), and wherein the at least one strip of packaging material (12) is positioned in the region of the opening (25) in order to be applied to the first end side of the group (10) of packages (10).

7. The method as claimed in claim 5, wherein two parallel strips of packaging material (12) are attached to the group (10) of packages (11) as a strapping, wherein the two strips of packaging material (12) are simultaneously supplied by the suction drum (15) and then attached.

8. The method as claimed in claim 1, wherein a mouthpiece (16), through which the group (10) of packages (11) is moved before the at least one strip of packaging material (12) is applied to the group (10), is arranged upstream from the suction drum (15).

9. The method as claimed in claim 1, wherein the group (10) of packages (11) are transported in a transporting direction (28) in the region of the suction drum (15) by means of a carrier belt (13), wherein the group (10) of packages (11) is held tensioned between successive carriers (14) of the carrier belt (13).

10. A method for strapping a group (10) of packages (11) of the cigarette industry with a strip of packaging material (12), wherein the packages (11) are brought together to form a cuboid group (10) and are then strapped with at least one strip of packaging material (12), comprising providing the at least one strip of packaging material (12) on one side with a layer of adhesive, and completely strapping the group (10) of packages (11) with the at least one strip of packaging material (12), wherein the layer of adhesive is brought into direct contact with the packages (11) of the group (10), wherein the ends (33) of the at least one strip of packaging material (12) are folded one after the other into the second end side so that they overlap each other, wherein the ends (33) of the at least one strip of packaging material (12) is applied by folding devices (31, 32) which are arranged inside an applicator, wherein the applicator is a suction drum (15), whilst the group (10) of packages (11) is moved through the suction drum (15).

11. The method as claimed in claim 10, wherein the ends (33) of the at least one strip of packaging material (12) are held by means of suction before the ends (33) of the strip of packaging material (12) are applied to the group (10) of packages (11).

12. The method as claimed in claim 10, wherein at least one new strip of packaging material (12) is supplied for the next group (10) of packages (11) whilst the ends (33) of the at least one strip of packaging material (12) are being applied.

13. A device for strapping a group (10) of packages (11) of products of the cigarette industry with a strip of packaging material (12), wherein the packages (11) are brought together to form a cuboid group (10) and are strapped with at least one strip of packaging material (12), wherein the at least one strip of packaging material (12) is provided on one side with a layer of adhesive, and wherein the device is configured to completely strap the group (10) of packages (11) with the at least one strip of packaging material (12), wherein the layer of adhesive is brought into direct contact with the packages (10) of the group (11), comprising an applicator, wherein the applicator is a suction drum (15), through which the group (10) of packages (11) can be moved, wherein the at least one strip of packaging material (12) is held against at least one contact surface of the applicator by means of a vacuum, and wherein the layer of adhesive faces away from the contact surface.

14. The device as claimed in claim 13, wherein the device is configured to hold the at least one strip of packaging material (12) against a peripheral surface of the suction drum (15).

15. The device as claimed in claim 14, wherein the suction drum (15) is driven in rotation, wherein the group (10) of packages (11) can be transported through the suction drum (15) between two suction rollers (22) of the suction drum (15) which are arranged parallel to and at a distance from each other and which have at least one contact surface.

16. The device as claimed in claim 15, wherein the suction drum (15) has at least one opening (25) in order to enable the transport of the group (10) of packages (11) through the suction drum (15), and in that the at least one strip of packaging material (12) is positioned in the region of the opening (25) in order to be applied to the first end side of the group (10) of packages (11).

17. The device as claimed in claim 13, wherein the device further comprises folding devices (31, 32) for applying two ends (33) of the at least one strip of packaging material (12) to the group (10) of packages (11), which are arranged inside the suction drum (15).

18. The device as claimed in claim 17, wherein the device is configured to hold the ends (33) of the at least one strip of packaging material (12) by means of suction before the ends (33) of the strip of packaging material (12) are applied to the group (10) of packages (11).

19. The device as claimed in claim 13, further comprising a mouthpiece (16), through which the group (10) of packages (11) is moved before the at least one strip of packaging material (12) is applied to the group (10), is arranged upstream from the suction drum (15).

20. The device as claimed in claim 13, wherein the group (10) of packages (11) can be transported in a transporting direction (28) in the region of the suction drum (15) by means of a carrier belt (13), wherein the group (10) of packages (11) is held tensioned between successive carriers (14) of the carrier belt (13).

* * * * *